United States Patent [19]

Matossian

[11] Patent Number: 4,994,711

[45] Date of Patent: Feb. 19, 1991

[54] HIGH BRIGHTNESS SOLID ELECTROLYTE ION SOURCE

[75] Inventor: Jesse N. Matossian, Woodland Hills, Calif.

[73] Assignee: Hughes Aircraft Company, Los Angeles, Calif.

[21] Appl. No.: 455,110

[22] Filed: Dec. 22, 1989

[51] Int. Cl.[5] ..... H01J 27/06

[52] U.S. Cl. ..... 313/362.1; 313/363.1; 313/230; 313/336; 250/423 R; 250/423 F

[58] Field of Search ..... 313/230, 359.1, 362.1, 313/336, 363.1; 315/111.81; 250/423 F, 423 R

[56] References Cited

U.S. PATENT DOCUMENTS

| | | | |
|---|---|---|---|
| 4,367,429 | 1/1983 | Wang et al. | 313/230 X |
| 4,670,685 | 6/1987 | Clark, Jr. et al. | 313/230 |
| 4,783,595 | 11/1988 | Seidl | 250/423 R |

*Primary Examiner*—Donald J. Yusko
*Assistant Examiner*—N. D. Patel
*Attorney, Agent, or Firm*—P. M. Coble; W. K. Denson-Low

[57] ABSTRACT

A solid electrolyte ion source has an emitting tip which is small enough to concentrate an elecric field from an extraction plate and thereby significantly increase the extracted current density compared to prior solid electrolyte sources. The source is heated to a temperature sufficient to induce a thermionic ion emission from the tip. The ion emission can be varied independent of the extraction field by varying the degree of heating, thereby preserving a constant focused ion beam spot size during changes of beam brightness. The tip preferably has a radius in the approximate range of 1–10 microns. The source can be used for ion-microprobe surface analysis and micro-circuit fabrication applications previously unavailable with solid electrolyte sources.

10 Claims, 1 Drawing Sheet

HIGH BRIGHTNESS SOLID ELECTROLYTE ION SOURCE

BACKGROUND OF THE INVENTION

1. Field of the Invention

This invention relates to high brightness ion sources for focused ion beams, and more particularly to high brightness solid state ion sources formed from a solid electrolyte material.

2. Description of the Related Art

Various types of ion sources have been developed for use in focused ion beam (FIB) systems. FIBs have been used in a number of different applications, such as the fabrication of advanced semiconductor microcircuits and ion-microprobe analysis of surfaces. The principal types of ion sources developed thus far may be classified as (1) gas field ionization sources; (2) liquid metal sources; (3) plasma sources; and (4) solid electrolyte sources.

(1) Gas Field Ionization Sources

Gas field ionization (GFI) sources are based upon the field-emission microscope, and are described for example in R. J. Blackwell, "Experimental Focused Ion Beam System Using a Gaseous Field Ion Source", *Journal of Vacuum Science Technology*, Vol. 1, pages 82-86, Jan./Feb. 1985. The gas field ionization occurs in the immediate vicinity of an extremely sharp submicrometer-radius tip. The source has a typical brightness of about $10^8$A/cm$^2$/sr (amperes/square centimeters/ steradian), and can provide FIBs of gas ions such as H, He, Ar and Xe, at currents ranging from $10^{-8}$A-$10^{-9}$A. The low ion energy spread and small virtual sources sizes make gas field ionization sources highly desirable for very high resolution focused beams.

In the GFI source, since the source of ions is a gas, the number of atoms available for ionization is limited by the arrival rate of atoms in the vicinity of the small needle which provides the tip where ionization takes place. The needle is typically cooled to liquid helium temperatures and the gas pressure in the ionization region increased. The maximum gas pressure is limited by electrical breakdown of the gas. As a result, the source must be differentially pumped, in addition to providing liquid helium cooling.

(2) Liquid Metal Sources

A liquid metal ion (LMI) source is disclosed in U.S. Pat. No. 4,670,685 to Clark, Jr. et al., assigned to Hughes Aircraft Company, the assignee of the present invention. Electric current is passed through a heater ribbon, liquefying the material such as gallium used as the ion source. The liquified gallium then wets the ribbon and a needle assembly. An extraction voltage is applied between the needle and an extraction electrode, creating a very large electric field in the region of the needle tip, which has a radius of less than about 10 microns. The electric field causes the liquid to be drawn from the needle tip into a cone with an apparent ion emission point size of less than 0.05 microns. For extracted current levels up to about 60 microamps, ions are believed to be created by field evaporation from the protruding liquid cone.

While the tip of the needle employed in the liquid metal source has a radius less than about 10 microns, it is still relatively dull compared to the needle used for a gas field ionization source. Applying the strong electric field causes the liquid metal to form a cusp, and this cusp becomes the emitting point for the source. The electrostatically shaped liquid point is relatively insensitive to contaminants and effects that might dull the solid metal point used in the gas field source. The liquid metal source can deliver a relatively high current (about $10^{-6}$ amps) with a brightness of about $10^6$A/cm$^2$/sr and can produce ions of B, As, Ga and Cs with typical energy spreads of 4.5 eV or more.

(3) Plasma Sources

Plasma sources are another type of ion source. The plasma source relies upon the electron-bombardment of gas atoms to produce a gas discharge of positive ions and electrons. Plasma sources are capable of producing ions used in the LMI and GFI sources but with much lower brightness, typically in the range of 1-10 A/cm$^2$-sr. Neither the LMI nor the GFI sources, however, produce oxygen ions which are used in the surface analysis of solids. An oxygen plasma source that is currently produced by the Perkin Elmer Company uses a duoplasmatron gas discharge plasma source for producing oxygen ions. It produces a brightness on the order of about 10 A/cm$^2$-sr. However, this brightness is far too small for many focused ion beam applications. The brightness of plasma sources is limited because the current density in practical plasma devices is on the order of 1-10 mA/cm$^2$.

(4) Solid Electrolyte Sources

The fourth type of ion source discussed here relates to the subject of this invention: the solid electrolyte ion source. Solid electrolyte materials such as zeolite $(Cs_2O)$ $(Al_2O_3)$ $(SiO_2)_{10}$, an alkali-ion conductor, and zyttrite (yttria-doped zirconia) $(ZrO_2)_{0.9}$ $(Y_2O_3)_{0.1}$, an oxygen-ion conductor, are well known and have very high ionic conductivity with relatively low electronic conductivity (Breck, D. W., *Zeolite Molecular Sieves*, Wiley, New York, 1973, and Mahan, G. D. and Roth, W. L., *Superionic Conductors*, Plenum, 1976).

When heated to thermionic temperatures (on the order of 1100° C.) in vacuum, the ions in these materials can be extracted by an externally-applied electric field to form a solid state ion source. Solid electrolyte ion sources, like the zeolites for example, are convenient and simple to use because the ions already exist inside the solid electrolyte; no separate ion-production process is required and no external source of atoms, like a gas tank for example, is required. Solid electrolyte ion sources are thermally very stable and compatible with ultra high vacuum systems (on the order of $10^{-10}$ Torr) There is no significant gas load and the energy spread of the emitted ions is very small, on the order of 0.1 eV.

The emitted ion current density from solid electrolyte ion sources is influenced by both the temperature and the electric field used to extract ions. A comprehensive, detailed study of the cesium ion-emission mechanism from zeolites is provided in a publication by the present inventor, J. N. Matossian, "The Thermionic Emission of Positive Cesium Ions from Zeolite", *Ph.D. Thesis*, Stevens Institute of Technology, May 1983.

The ion emission from solid electrolytes is known to have a Schottky dependence on the electric field established at the emitting surface by the applied voltage. There is a linear dependence of the current density on the square root of the applied voltage when plotted on a semilog graph; therefore the ion emission obeys the well known Schottky equation for field-enhanced emission, $$J = J_o \exp\left(\frac{4.39\sqrt{V}}{kT\sqrt{d}}\right) = J_o \exp\left(\frac{4.39\sqrt{E}}{kT}\right)$$

where $J_0$ is the current density for zero applied voltage, V is the applied voltage, d is the gap between the emitter surface and the collector, T is the zeolite temperature, and E is the electric field at the zeolite emitting surface, all parameters using the cgs system. For a flat emitting surface the electric field is uniform so that $V = Ed$. For an applied voltage of 1.2 kV, a gap of 0.3 cm, and a temperature of 1100° C., the steady-state current density is about 0.1 mA/cm$^2$. It can be shown that to achieve a factor-of-ten increase in the current density ($J \simeq 1$ mA/cm$^2$) at the same temperature, the applied voltage (or surface electric field) must be increased by about a factor of 20 (24 kV).

Besides having a Schottky-dependence on the applied electric field, the ion emission from solid electrolyte ion sources is also known to have a Richardson temperature dependence. The variation of $J_0$ with temperature is linear when plotted on a semi-log graph, indicating that the temperature dependence of the ion emission characteristic obeys the well known Richardson equation:

$$J_o = A\sqrt{T}\exp\left(-\frac{\phi}{kT}\right)$$

where $\phi$ is the ionic work function of the zeolite surface and A is the Richardson pre-exponential factor.

Applications

There are basically two types of applications for any type of ion source: broad beam and focused ion beam applications. Solid electrolyte ion sources have predominantly been used in broad beam applications. For example, solid electrolyte ion sources have been used to produce broad beams of ions such as $Cs^+$, $Li^+$ and $Ba^+$ for example, for a number of applications ranging from heavy-ion probes for plasma fusion experiments, the production of negative hydrogen ions by ion sputtering, and as an ion source for surface analysis work. The focused ion beam applications of solid electrolyte ion sources have been limited because of their apparent low brightness.

For the solid electrolyte ion source cesium-zeolite, a steady-state cesium ion current density on the order of 0.1 mA/cm$^2$ is achieved at a temperature of about 1100° C. for an emitting area on the order of 0.5 cm$^2$ and an extraction voltage of 5 kV. For these parameters, the Langmuir-limit brightness is typically about 1 A/cm$^2$—sr, which is too small for any focused ion beam applications.

For a fixed extraction voltage, increased source brightness can be achieved by increasing the total emitted current while keeping the emitting area and temperature fixed. Increasing the source brightness by increasing the extraction voltage is not very practical. For example, as indicated above it is necessary to increase the extraction voltage by a factor of twenty to increase the source current density (and therefore the source brightness) by a factor of ten. To make solid electrolyte ion sources useful for focused ion beam applications would require a source brightness of at least 1000 A/cm$^2$—sr. However, achieving this by increasing the extraction voltage only would require an applied voltage near 200 kV, which then makes the source use impractical.

Keeping the applied voltage constant in the 1-5 kV range, two techniques have previously been developed that achieve increased source brightness by increasing the total ion current extracted from zeolites. Adsorbing monolayer coverages of electronegative gas atoms on the emitting surface (flat and with about 0.5 cm$^2$ area) of cesium zeolite, J. Matossian and M. Seidl, "Enhanced Emission of Cesium Ions from Zeolite", *J. Appl. Physics*, Vol. 53, No. 9, pp. 6376-6382, Sept. 1982, demonstrated that a significant increase (up to three orders of magnitude) in emitted current density could be achieved, but only during pulsed operation of the extraction voltage (voltage pulse duration of a few microseconds). The enhanced current density, however, decayed during steady-state operation. Though a source brightness in excess of 1000 A/cm$^2$—sr was demonstrated, the practicality of this brightness-enhancement technique was limited because of the requirement for pulsed operation and the fact that electronegative gas atoms are undesirable in a surface analysis vacuum system.

A significant increase in the steady-state emitted current density of ions from zeolite has recently been demonstrated by M. Seidl (U.S. Pat. No. 4,783,595). By coating the flat emitting source of zeolite, about 0.3 cm$^2$ in area, with a porous tungsten layer, steady-state current densities of up to 10 mA/cm$^2$ have been achieved. The Langmuir-limit brightness of this source has been found to be on the order of 25 A/cm$^2$—sr (S. I. Kim and M. Seidl, "Solid State Cesium Ion Microprobe", Poster D43, *First International Conference on Ion Sources*, Berkeley, Calif., July 10-14, 1989). A cesium ion source based on this design is presently being marketed by Kratos Analytical Instruments Corp. Because of the presence of the porous tungsten coating on the zeolite surface, the ion emission mechanism is due to surface-ionization of cesium at the tungsten surface and not due to ion emission from zeolite. In this case, the zeolite acts only as a reservoir for cesium which is ionized at the tungsten surface.

SUMMARY OF THE INVENTION

The purpose of the present invention is to provide a new approach to increase the brightness of solid electrolyte ion sources. This goal is achieved by shaping the emitting surface into a sharp point. For the same applied voltage used for a flat emitting surface, a significant increase in the surface electric field is achieved in the vicinity of the tip. By heating the tip to thermionic temperatures, a significant increase in the emitted ion current density is achieved, resulting in a significant increase in source brightness compared to conventional solid electrolyte ion sources. The current density, and therefore the brightness, is controlled by two separate mechanisms: the applied voltage and the temperature.

These and other features and advantages of the invention will be apparent to those skilled in the art from the following detailed description, taken together with the accompanying drawings, in which:

DETAILED DESCRIPTION OF THE INVENTION

The present invention provides a new type of solid electrolyte ion source that retains the advantages of prior sources using solid electrolytes, but achieves a substantially higher brightness that permits it to be used for many focused ion beam applications previously not achievable because of the low source brightness. These include microcircuit fabrication, ion-microprobe analyses, and thin film deposition and preparation.

In contrast to past attempts to increase the brightness of solid electrolyte ion sources which have concentrated on attempting to increase the total current from a flat, broad emitting area, the present invention achieves an increased source brightness by changing the shape of the emitting surface into a sharp point. Advantage is taken of the Schottky field-enhanced ion emission characteristics of solid electrolyte ion sources. For the same extraction voltage used for flat, broad emitting surfaces, a significant increase in the surface electric field is achieved in the vicinity of the sharp point. By raising the temperature to a value that allows thermionic emission of the ions, a significant increase in the emitted current density, and therefore the source brightness, is achieved.

Figure 1:
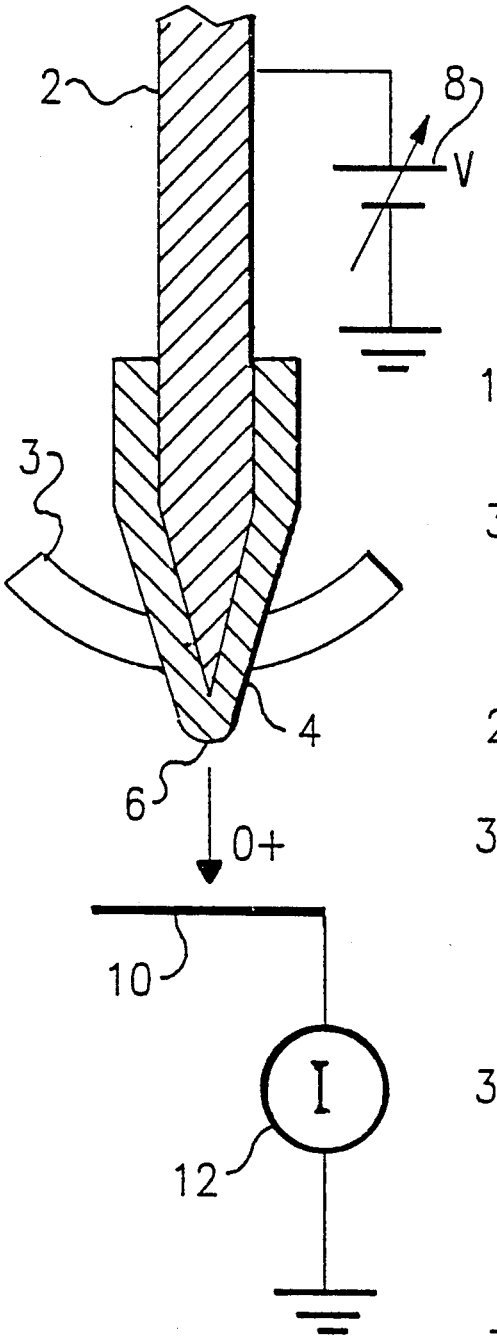
FIG. 1 is a schematic sectional view of an arrangement used to demonstrate the invention.

FIG. 1 shows a schematic diagram of the experimental apparatus that was used to demonstrate the basic principle to increase source brightness. Several liquid metal ion source tungsten/rhenium needle tips 2 were plasma sprayed with solid electrolytes 4; sodium zeolite (for sodium ions) and zyttrite (for oxygen ions). The thickness of the coatings was measured to be about 1 mil, and the radius of curvature of the emitting tip 6 was close to 50 microns for all the needles coated. Since solid electrolytes have finite conductivity, it is important to have a thin coating in the vicinity of the tip 6 to avoid a large voltage drop across the solid electrolyte bulk. To provide a large reservoir of ions (long source lifetime), the rest of the coating 4 along the sides can be as thick as desired. It should be noted that the radius of curvature of the tip 6 should be kept as small as possible, preferably in the range of 1–10 microns. For proving the concept in the invention, a radius of curvature of 50 microns was used; this was not optimum, but served for demonstration purposes.

The source tip temperature was controlled by supplying heater power to a filament 3 from a variable voltage source (not shown). Another variable voltage source 8 was used to extract positive ions. Emitted ions were collected by a collector 10, and the current measured with a current meter 12. The gap between the emitter tip and the collector was 0.085 inches. A tantalum foil radiation shield (not shown) surrounded the heater and emitter to minimize radiated power loss when the ion source was heated.

The variation of measured emitted ion current ($O^+$ ions) with extraction voltage at four different source temperatures was found to describe generally straight lines when plotted on semi-log graph paper. This verifies that the ion emission is described by the Schottky field-enhanced emission equation described previously. The verification of the Schottky equation for the extracted current indicates that the ion emission is field-enhanced.

By extrapolating the measured results to zero extraction voltage, the zero-field emitted current $I_0$ can be determined as a function of the emitter tip temperature T. When a plot was made of $I_0/\sqrt{T}$ versus $1/T$, the data was found to be described again by a generally straight line on semilog paper. This verified the presence of thermionic emission of oxygen atoms from the zyttrite sources in accordance with the Richardson equation described earlier.

For a tip temperature of 1850° C., the maximum source brightness at an extracted voltage of 5 kV was calculated at approximately $10^3 A/cm^2-sr$. This is approximately 2 orders of magnitude higher than what is available with present solid electrolyte ion sources. To achieve higher brightness a sharper point is required, preferably in the range of 1–10 micron radius. The ultimate limitation on the tip radius will be determined by the grain size of the solid electrolyte material.

The invention relies upon a small emitting tip to achieve a high electric field at the tip. The electric field produced at the surface of a conductor that is curved with a radius of curvature "a" and maintained at a voltage of value "V", is given by the expression:

$$E = \frac{V}{a}$$

Keeping the applied voltage fixed, the electric field can be increased by reducing the radius of curvature "a". When an emission of ions is obtained from zeolite with a flat emitting surface and an applied voltage of about 1.2 kV across a gap of 0.3 cm, the electric field is uniform across gap d. The electric field $E_z$ at the surface of the emitting surface is therefore given by $$E_z = \frac{1200\ V}{0.3\ cm} = 4{,}000\ V/cm$$

If the emitting surface is shaped into a sharp point with a radius of curvature of 50 microns, the electric field at the emitting surface increases to $$E_z = \frac{1200\ V}{0.005\ cm} = 240{,}000\ V/cm$$

The electric field at the emitting surface is therefore enhanced by a factor of 60 without changing the applied voltage. As discussed previously, this is approximately the electric field strength required to increase the source brightness of zeolite to about 1000 $A/cm^2-sr$ with a flat emitting surface, but with an applied voltage of nearly 200,000 volts. Since the ion emission from solid is electrolytes is known to have a Schottky-dependence on the emitting surface electric field, a significant increase in the source brightness results for the same extraction voltage by shaping the emitting surface into a sharp point.

Figure 2:
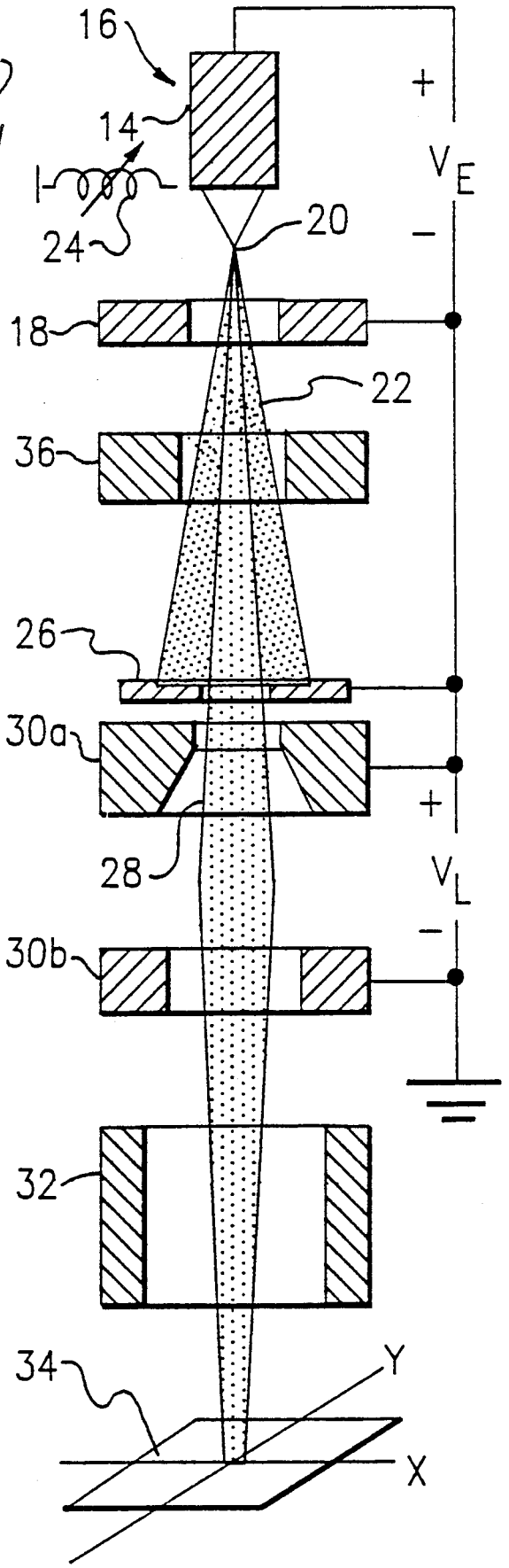
FIG. 2 is a schematic sectional view of a FIB system employing the ion source of the present invention.

FIG. 2 illustrates one important use of new solid electrolyte ion sources of the type illustrated in FIG. 1. The ion source 14 is mounted in a scanning ion probe 16. An extraction electrode 18, which is biased with respect to the ion source 14 by a voltage $V_E$, in this case a negative bias for the extraction of positive ions, draws ions out of the emitting tip 20 to form an ion beam 22. A source heating coil together with a variable power supply for the coil is represented by a variable heater 24 for the solid electrolyte source.

A small portion of beam 22, typically about 1 milliradian, is allowed to pass through an aperture 26 into the optics section of the scanning ion probe 16. A transmitted beam 28 emerging from the aperture 26 is passed through accelerating electrodes 30*a* and 30*b*, which increase the energy of the beam 28. The second accelerating electrode 30*b* is negatively biased with respect to the first electrode 30*a* by a voltage $V_L$. The accelerating electrodes 30*a* and 30*b* also serve to converge the beam 28, which then passes through electrostatic deflection electrodes 32 that deflect the beam from side-to-side to move in a scanning fashion across the surface of a target 34. The transmitted beam 28 can be used to write various patterns upon the surface of the target 34 in the form of ion implanted zones of controllable shape and type. Through the incorporation of a secondary electron detector (not shown), the beam may be used to image the target in a fashion similar to that of a scanning electron microscope. Finally, through the incorporation of a secondary ion mass spectrometer (not shown), the micro-composition of a very small region located on the target 34 may be analyzed in both a qualitative and quantitative manner.

Preferably, there is also provided an ExB mass spectrometer 36 to deflect ions of differing masses by differing amounts. The mass separator 36 is preferably a Wein velocity filter which acts as a mass separator because of the very low energy spread of the beam obtained from the new solid electrolyte ion source. The mass separator 36 is preferably positioned between the extraction electrode 18 and the aperture 26. The fields within the mass separator 36 deflect the moving ions passing therethrough by amounts which are related to the mass, velocity and charge of the ions in the beam. By varying the strength of the magnetic and electrical fields and the positioning of the mass separator 36, it is possible to allow only a single desirable species to pass through the aperture 26 to be implanted in the target 34, while all other species are deposited on the upper side of the aperture 26.

The new ion source described above can be used to obtain the full range of positive and negative ions available with prior solid electrolyte sources, but achieves a significantly higher brightness that makes them useful for surface analysis systems and microcircuit fabrication. No gas load, vacuum pumps, propellant tank or gas discharge is required. The new source is expected to have the same very long lifetime of broad-beam solid electrolyte ion sources. By providing an independent temperature control, the brightness can be adjusted without the necessity of changing the extraction voltage.

While achieving a substantially higher brightness than conventional solid electrolyte sources, the invention retains the benefits of solid electrolyte sources over LMI and GFI sources. These include:

1. The ion emission from solid electrolyte ion sources can be independently controlled by either the temperature or the applied voltage. For LMI/GFI sources, ion emission can only be controlled by the applied voltage.

2. Since ions exist inside a solid electrolyte, an extremely high surface electric field is not required to emit ions. For the LMI/GFI sources, source operation is not possible without an intense electric field (on the order of 1 V/Angstrom) at the emitting surface; ions are produced by field-emission at the emitting tip.

3. Only positive ions can be produced with LMI/GFI sources. The ion generation process of field-emission does not hold for negative ions. With the present invention, reversing the polarity of the applied voltage should result in an extraction of negative oxygen ions, since zyttrite conducts $O^{--}$ ions in the solid. The invention is applicable to negative ions as well as positive ions.

4. For LMI sources only materials that can be liquified upon heating, like Ga, Cs and Au, can be used to produce ions. In the GFI source only gas atoms like H and Xe can be produced. In the solid electrolyte ion source both gas and liquid-metal ions can be produced, if they conduct inside a solid electrolyte. Cs and O are two examples.

5. The energy spread in solid electrolyte ion sources is smaller (on the order of 0.1 eV) than in the LMI and the GFI sources (on the order of several eV). But the current density in the solid electrolyte ion source is much lower than in either the LMI or GFI source.

While several illustrative embodiments of the invention have been shown and described, numerous variations and alternate embodiments will occur to those skilled in the art without departing from the spirit and scope of the invention. For example, while a tapered emitting tip has been described above as a practical way of obtaining a small ion-emission area, it may be possible to provide the solid electrolyte source as a very thin wire of constant diameter. Accordingly, it is intended that, within the scope of the appended claims, the present invention may be practiced otherwise than as specifically described.

I claim:

1. A high brightness ion source, comprising:

an ion emitting member formed from a solid electrolyte material and having an emitting tip, means for establishing an ion extracting electric field directed onto said emitting tip, said tip having dimensions small enough to concentrate said electric field in the immediate vicinity of the tip compared to the field at more remote locations from the tip, and means for heating said ion emitting member to a temperature sufficient to induce a thermionic ion emission from said tip.

2. The high brightness ion source of claim 1, said means for heating the ion emitting member including means for varying its degree of heating, and thereby varying the ion emission from the member independent of the electric field.

3. The high brightness ion source of claim 1, wherein said ion emitting member is tapered to said tip.

4. The high brightness ion source of claim 3, wherein said tip has a radius in the approximate range of 1–10 microns.

5. The high brightness ion source of claim 1, said ion emitting member comprising a conductive core having a solid electrolyte coating thereon.

6. A high brightness ion source, comprising:

an ion emitting member formed from a solid electrolyte material and having a tapered ion emitting tip terminating at an apex, an extraction plate positioned opposite to the ion emitting tip of said member and including a beam opening in alignment with said tip, means for maintaining said ion emitting member at a reference voltage, means for applying a voltage to said extraction plate sufficient to extract ions from said tip and form said ions into a beam, and means for heating said ion emitting member to a temperature sufficient to add a thermionic ion emission to the ion beam extracted from said tip.

7. The high brightness ion source of claim 6, said means for heating the ion member including means for varying its degree of heating, and thereby varying the ion current in said extracted ion beam.

8. The high brightness ion source of claim 6, said apex having a radius of about 100 microns or less.

9. A method for forming an ion beam with a high brightness source, comprising:

providing an ion emitting member formed from a solid electrolyte material having an ion emitting tip, concentrating an electric field onto said tip, said tip being sufficiently small and said electric field sufficiently strong to extract an ion beam from said tip, heating said member to a temperature sufficient to induce a thermionic ion emission from said tip in addition to said extracted beam, and controlling the heating of said member to produce a desired ion beam current.

10. The method of claim 9, further comprising the steps of focusing the beam to a spot, and varying the ion beam current by varying the heating of said member under substantially constant electric field conditions, thereby preserving a substantially constant spot size.

* * * * *